US006763909B2

(12) United States Patent
Svendsen

(10) Patent No.: US 6,763,909 B2
(45) Date of Patent: Jul. 20, 2004

(54) SUCTION MUFFLER

(75) Inventor: Christian Svendsen, Krusaa (DE)

(73) Assignee: Danfoss Compressors GmbH, Flensburg (DE)

( * ) Notice: Subject to any disclaimer, the term of this patent is extended or adjusted under 35 U.S.C. 154(b) by 26 days.

(21) Appl. No.: 10/153,083

(22) Filed: May 22, 2002

(65) Prior Publication Data

US 2002/0185333 A1 Dec. 12, 2002

(30) Foreign Application Priority Data

Jun. 11, 2001 (DE) ..... 101 28 225

(51) Int. Cl.[7] ..... F01N 5/00
(52) U.S. Cl. ..... 181/227; 181/211
(58) Field of Search ..... 181/227, 211, 181/226, 231, 232, 238, 247, 249, 250, 251, 229, 224, 228, 239

(56) References Cited

U.S. PATENT DOCUMENTS

| | | | | | |
|---|---|---|---|---|---|
| 3,750,840 | A | | 8/1973 | Holme | 181/57 |
| 5,173,034 | A | * | 12/1992 | Riffe | 417/312 |
| 5,330,329 | A | * | 7/1994 | Clark | 417/312 |
| 5,496,156 | A | * | 3/1996 | Harper et al. | 417/312 |
| 6,155,067 | A | * | 12/2000 | Ono et al. | 62/296 |
| 6,158,214 | A | * | 12/2000 | Kempka et al. | 60/302 |
| 6,415,888 | B2 | * | 7/2002 | An et al. | 181/281 |
| 6,547,032 | B2 | * | 4/2003 | Yoon et al. | 181/229 |
| 6,547,535 | B2 | * | 4/2003 | Kueon | 417/312 |

FOREIGN PATENT DOCUMENTS

| | | | |
|---|---|---|---|
| DE | 36 22 996 C2 | 6/1989 | F04B/39/12 |
| DE | 36 45 083 C2 | 8/1991 | F04B/39/12 |
| DE | 195 22 383 C2 | 6/1997 | F04B/39/12 |
| DE | 199 23 734 A1 | 11/2000 | F04B/39/12 |

OTHER PUBLICATIONS

"Sporlan Bulletin 30–10", Jan. 1993, pp. 17 and 18.

* cited by examiner

*Primary Examiner*—Kimberly Lockett
(74) *Attorney, Agent, or Firm*—McCormick, Paulding & Hauber LLP

(57) ABSTRACT

The invention concerns a suction muffler for a hermetically enclosed compressor with a housing that has at least a first and a second chamber, separated from each other by means of a division wall and connected with each other by means of a throttling channel, which is designed to allow flow from the first to the second chamber.

The throttling channel includes a lateral opening, which opens into a chamber via a branch channel.

12 Claims, 4 Drawing Sheets

SUCTION MUFFLER

CROSS-REFERENCE TO RELATED APPLICATIONS

This application is entitled to the benefit of and incorporates by reference essential subject matter disclosed in German Patent Application No. 101 28 225.7 filed on Jun. 11, 2001.

FIELD OF THE INVENTION

The invention concerns a suction muffler for a hermetically enclosed compressor with a housing that has at least a first and a second chamber, separated from each other by means of a dividing wall and connected with each other by means of a throttling channel, which is designed to allow flow from the first to the second chamber.

BACKGROUND OF THE INVENTION

A suction muffler of this kind is known from DE 199 23 734. This muffler has a housing that consists of an upper part, a bottom part and an insert. The insert divides the housing into two chambers, which are connected with each other by means of a tubular throttling channel. The throttling channel is made as part of the insert. Together with the housing bottom part, a wall section of the insert forms a capillary slot, in which oil can accumulate. This improves the noise damping of the muffler. The channel extends substantially into the first chamber, whereas in the second chamber merely a short channel section projects over the bottom surface of the insert.

Among other things, such suction mufflers serve the purpose of damping sound waves resulting from the opening and closing movements of a suction valve arrangement, which is arranged in a cylinder head of a compressor. The noise caused by this can be undesirably transferred to the environment via the volume enclosed by the compressor shell.

An additional suction muffler is known from U.S. Pat. No. 3,750,840 A. In this case, the throttling channel connecting the two chambers of the housing is formed by a channel structure pressed into an insert plate. The insert plate is fixedly connected with a division plate. Openings formed in the insert plate and in the division plate provide the connection between the two chambers. This design is relatively expensive to manufacture.

SUMMARY OF THE INVENTION

The invention is based on the task of improving noise suppression.

With a suction muffler as mentioned in the background, this task is solved in that the throttling channel comprises a lateral opening, which opens into a chamber via a branch channel.

Thus, the lateral opening is not directly connected with the chamber, into which it opens. On the contrary, an additional branch channel is arranged between the opening in the wall of the throttling channel and the actual exit into the corresponding chamber, which branch channel can further contribute to noise suppression. Basically, this provides in a simple manner an extension of the distance which must be travelled by the sound waves. As both the throttling channel and the branch channel have limited cross-sectional surfaces, a muffling of the sound waves takes place in both channels.

Preferably, the branch channel opens into the second chamber. The second chamber is the chamber which is closest to the outlet of the muffler and thus to the inlet of the compressor. Here, the sound waves still have their largest intensity so that a damping in the branch channel is preferred to take place here, before the sound waves reach the inside of the compressor housing through the inlet of the suction muffler.

Preferably, the throttling channel has a tubular section in the second chamber, in which the opening is arranged. Thus, the throttling channel can be extended into the second chamber by the tubular section. An extension of this kind is very advantageous for noise suppression. However, it has the disadvantage that oil, which is entrained by the gaseous refrigerant flowing through the throttling channel, can no longer flow off from the second chamber. The oil thus collecting up in the second chamber would cause a deterioration of the effective volume of the second chamber, which would again deteriorate noise suppression.

The opening now remedies the above-described problem. As the opening is arranged laterally, the oil in the second chamber can flow off when it reaches the level of the opening. This means that the oil can no longer collect up to the level of the tubular section, as the opening and the branch channel permit the oil to flow off, before it reaches the level of the tubular section. Thus, it is achieved that a relatively large volume of the second chamber is still available for noise suppression. Additionally, it is avoided that too much oil is drained off from the lubricating circuit of the compressor, which would, among other things, deteriorate the cooling of some components and have a negative influence on the life of the compressor.

It is particularly preferred that the opening is in the shape of a slot and that in the longitudinal direction the branch channel has a slot-like cross-section. This design has turned out to be particularly advantageous for noise suppression. The term "slot-like" suggests that in the cross-section the channel has a substantially larger dimension in one direction than in the other direction. Preferably, the larger dimension is parallel to the flow direction through the throttling channel. In principle, the channel thus has the shape of a flat plate, the plate having, of course, a certain, but small thickness.

Preferably, the opening ends at the bottom of the chamber. Due to gravity, oil that has been taken into the second chamber by the gas flow accumulates at the bottom of the chamber and can, as the opening goes right down to the bottom, flow back to the first chamber through this opening.

Preferably, the branch channel is limited by the bottom of the chamber. Thus, the oil is free to reach the opening of the branch channel, so that oil is prevented from accumulating in the second chamber.

Preferably, the opening is arranged at the lowest point of the chamber. Or, more precisely, the opening in the wall of the tubular section is extended down to the lowest point of the chamber. Oil that usually accumulates at the lowest point due to gravity is then free to flow off. In this case, an escape path is always available for any oil that starts accumulating.

Preferably, the length of the branch channel substantially corresponds to the height of the branch channel. The "length" of the branch channel means the distance from the opening to the oppositely arranged exit of the branch channel into the second chamber. The height is the extension perpendicularly to this, that is, the extension in parallel to the flow direction through the throttling channel. The adaptation to each other of length and height has turned out to be advantageous for the muffling qualities.

Preferably, the branch channel extends in an arch shape. The arch-shaped extension serves the purpose of improving the noise suppression.

It is particularly preferred that the branch channel runs substantially parallel to the circumferential wall of the throttling channel. In this case, the branch channel also provides an additional thermal isolation for the refrigerant flowing through the throttling channel, which means that the efficiency of the compressor on a whole is improved.

Preferably, the circumferential wall of the throttling channel forms a limiting wall of the branch channel. This results in a particularly simple design. Only one additional wall is required for the branch channel.

Preferably, the branch channel is open on the face side. This means that the branch channel has a second outlet opening, which may, for example, be arranged in the same level as the outlet opening of the throttling channel. Under certain circumstances, it can also be arranged in a different level. Thus, the flow resistance of the arrangement is reduced. The gas that passes through the throttling channel has a movement component in the direction of the longitudinal axis of the throttling channel. The face side opening of the branch channel now permits the gas to flow on with this movement component.

BRIEF DESCRIPTION OF THE DRAWINGS

In the following, the invention is explained in detail on the basis of preferred embodiments in connection with the drawings, wherein.

DETAILED DESCRIPTION OF THE PREFERRED EMBODIMENTS

Figure 1:
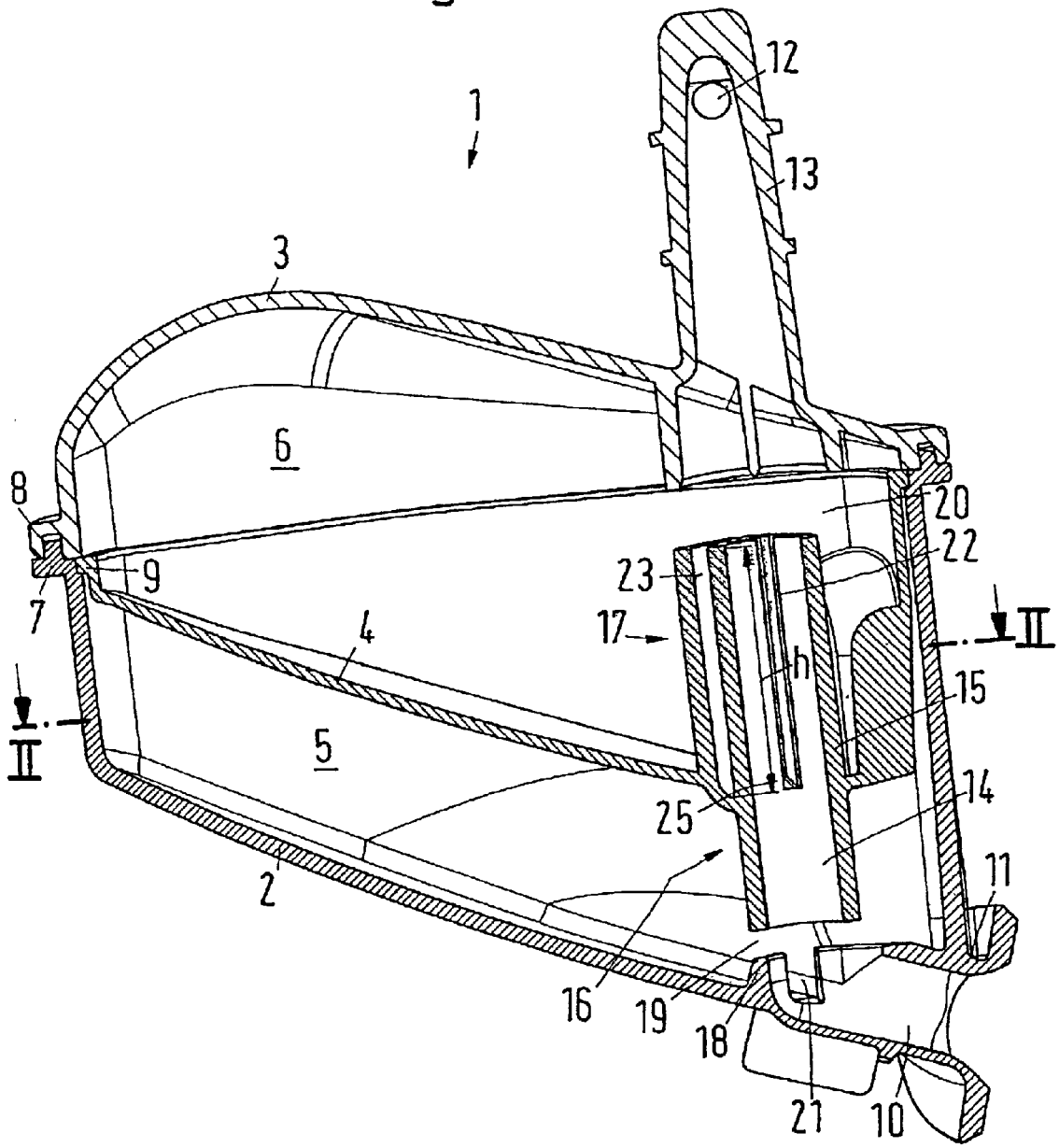
FIG. 1 is a longitudinal section through a suction muffler
Figure 2:
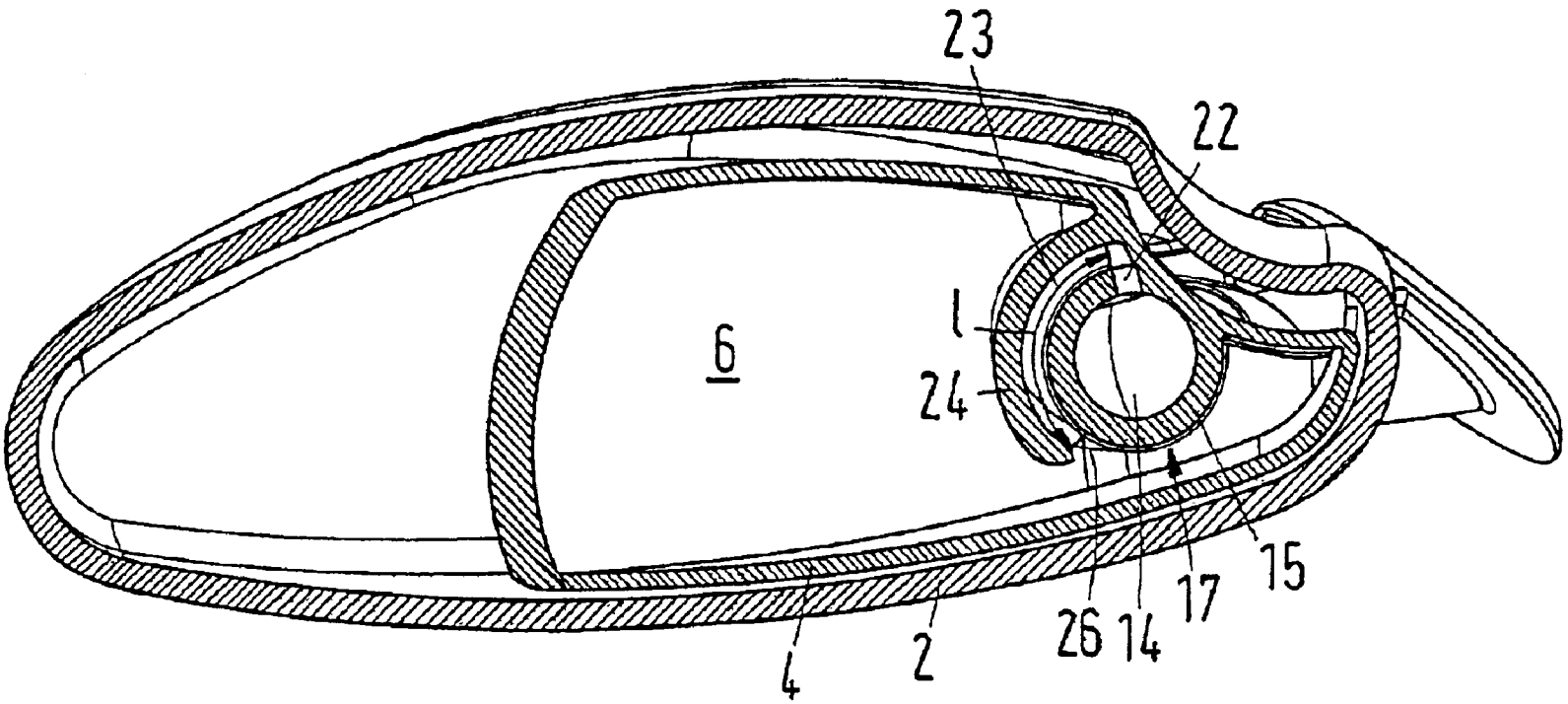
FIG. 2 is a section II—II according to FIG. 1
Figure 3:
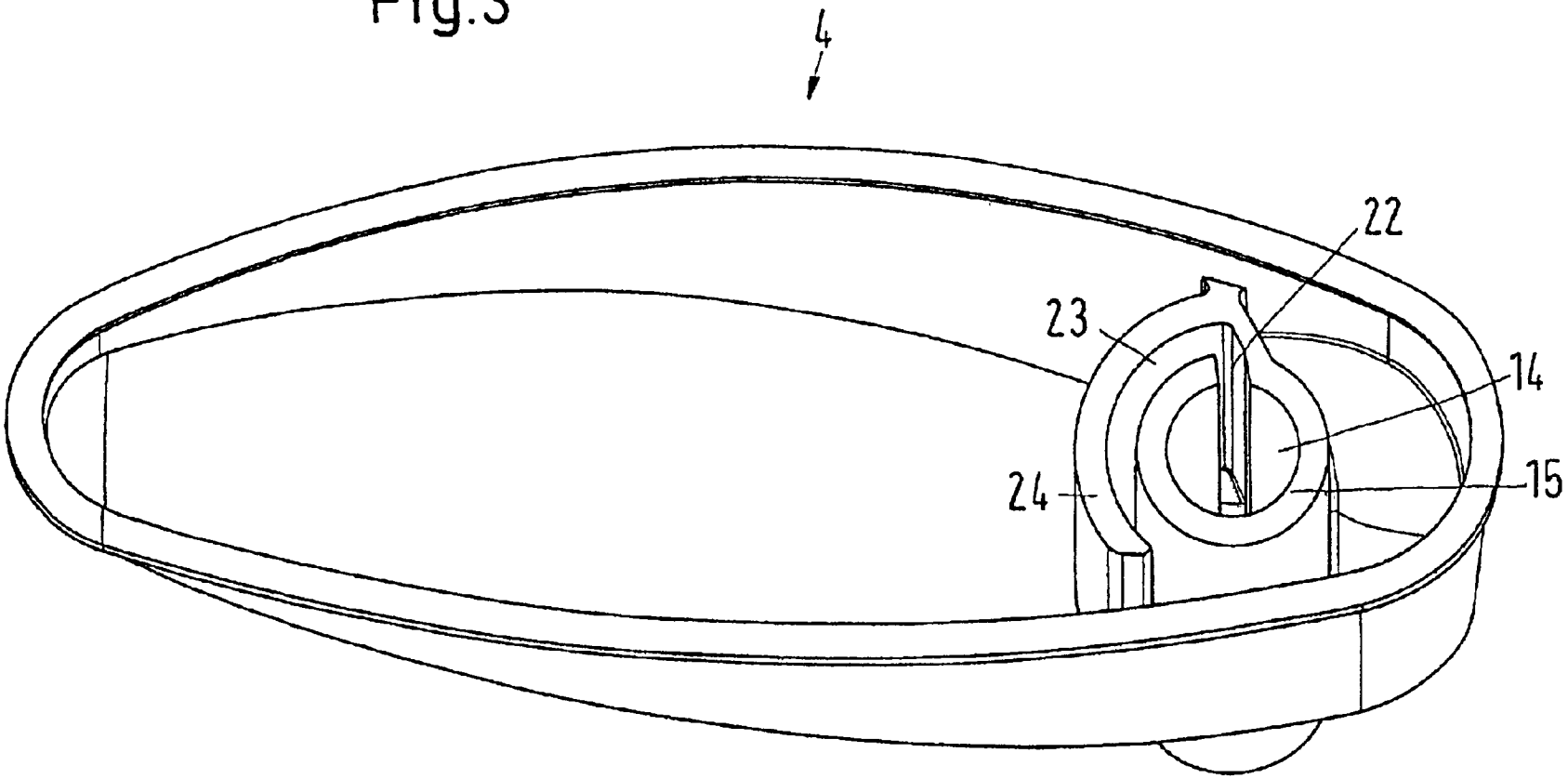
FIG. 3 is a perspective view of an insert

A suction muffler 1 has a bottom part 2, a top part 3, and between them an insert 4, which divides the housing into a first chamber 5 and a second chamber 6. The two housing parts 2, 3 and the insert 4 can be made of a plastic material, for example, polybutylene terephthalate (PBTP). These parts are connected with each other at their flanges 7, 8, 9 by means of a suitable connecting process, for example, bonding or welding.

The first chamber has an inlet 10, which is arranged in an inlet nozzle 11. The second chamber 6 has an outlet 12, which is arranged in an outlet nozzle 13.

The insert 4 is passed by a throttling channel 14, which extends in a pipe-like nozzle 15, of which a first section 16 is arranged in the first chamber 5, whereas a second section 17 is arranged in the second chamber 6. The second section 17 is longer than the first section 16.

The throttling channel 14 extends approximately coaxially to the outlet nozzle 13 and to an extension 18 of the inlet nozzle 11, which is somewhat angled in relation to the inlet 10. A distance 19 between the extension 18 and the nozzle 15 forms a connection to the first chamber 5. A distance 20 between the nozzle 15 and the outlet nozzle 13 forms a connection to the second chamber. In the extension 18 a lateral opening 21 is provided, through which oil that accumulates in the first chamber 5 can flow off through the inlet 10.

During operation, gaseous refrigerant enters through the inlet 10, flows through the throttling channel 14 from the first chamber 5 to the second chamber 6 and then reaches the outlet 12 through the outlet nozzle 13, the outlet 12 being connected with a compressor, which is not shown in detail.

The second section 17 of the pipe-shaped nozzle 15 has, in the wall of the nozzle 15, a slot-like opening 22, which goes right to the bottom wall of the second chamber 6 that is formed by the insert 4. As can be seen from FIG. 1, the slot-like opening 22 has, in the circumferential direction of the throttling channel 14 only a small width. However, the slot-like opening 22 has a relatively large height, which practically corresponds to the length of the second section 17 of the pipe-shaped nozzle 15. Thus, the slot-like opening 22 starts at the upper end of the pipe-shaped nozzle 15 and goes down to the bottom wall of the insert 4.

However, the slot-like opening 22 does not open direct into the second chamber 6, but into a branch channel 23, which has substantially the same cross-section as the slot-like opening 22. In a manner of speaking, the branch channel 23 is formed by an excursion of the slot-like opening 22. It has a length 1, which substantially corresponds to its height h. Also the branch channel 23 is open in the direction of the second chamber 6 at the upper end of the pipe-shaped nozzle 5.

On one side, the branch channel 23 is limited by the outer wall of the pipe-shaped nozzle 15 and on the other side by an outer limiting wall 24, which is substantially parallel to the outer wall of the pipe-shaped nozzle 15. Therefore, the branch channel is curved or arched.

As can be seen from FIG. 1, the bottom side of the branch channel 23 is limited by the insert 4. If required, the bottom wall of the insert 4 can additionally have a step 25, to create a bottom at a somewhat lower level. Oil that accumulates in the second chamber 6 can then enter the branch channel 23 through the outlet 26 of the branch channel 23 and flow on the bottom of the branch channel 23 to the slot-like opening 22. Here, it can enter the throttling channel 14 and flow off from the suction muffler through the inlet 10. This prevents the second chamber 6 from being filled with oil that is entrained by the gaseous refrigerant. If not for the slot-like opening 22 and the branch channel 23, this would be the case. An embodiment only having the slot-like opening 22 and not the branch channel 23 would still ensure the desired oil flow-off, however, the acoustic muffling effect would be very small. With the embodiment shown, a muffling behaviour is achieved, which approximately corresponds to the muffling behaviour of a throttling channel 14 with the length of the tubular nozzle. Due to the arched branch channel 23, the oil flow-off from the second chamber 6 is still possible. Additionally, the throttling channel 14 is thermally shielded by the branch channel 23 from the somewhat warmer housing walls, so that the cold refrigerant supplied will be less heated and absorb less heat energy. This has a positive effect on the efficiency of the compressor.

As the limiting wall 24 extends in parallel to the outer circumferential wall of the tubular nozzle 15, a particularly space-saving design is achieved, which takes away as little volume as possible from the second chamber 6. At the same time, the lateral opening of the branch channel 23 ends at the lowest spot of the insert 4, which permits a flow-off of all the oil that has accumulated in the second chamber 6. Also, the curved shape of the limiting wall 24 provides a mechanically more rigid structure, whose higher resonant frequency lies in an uncritical range. Also the tool used for making the insert 4, for example an injection mould, has a high rigidity and thus a long life.

Figure 4:
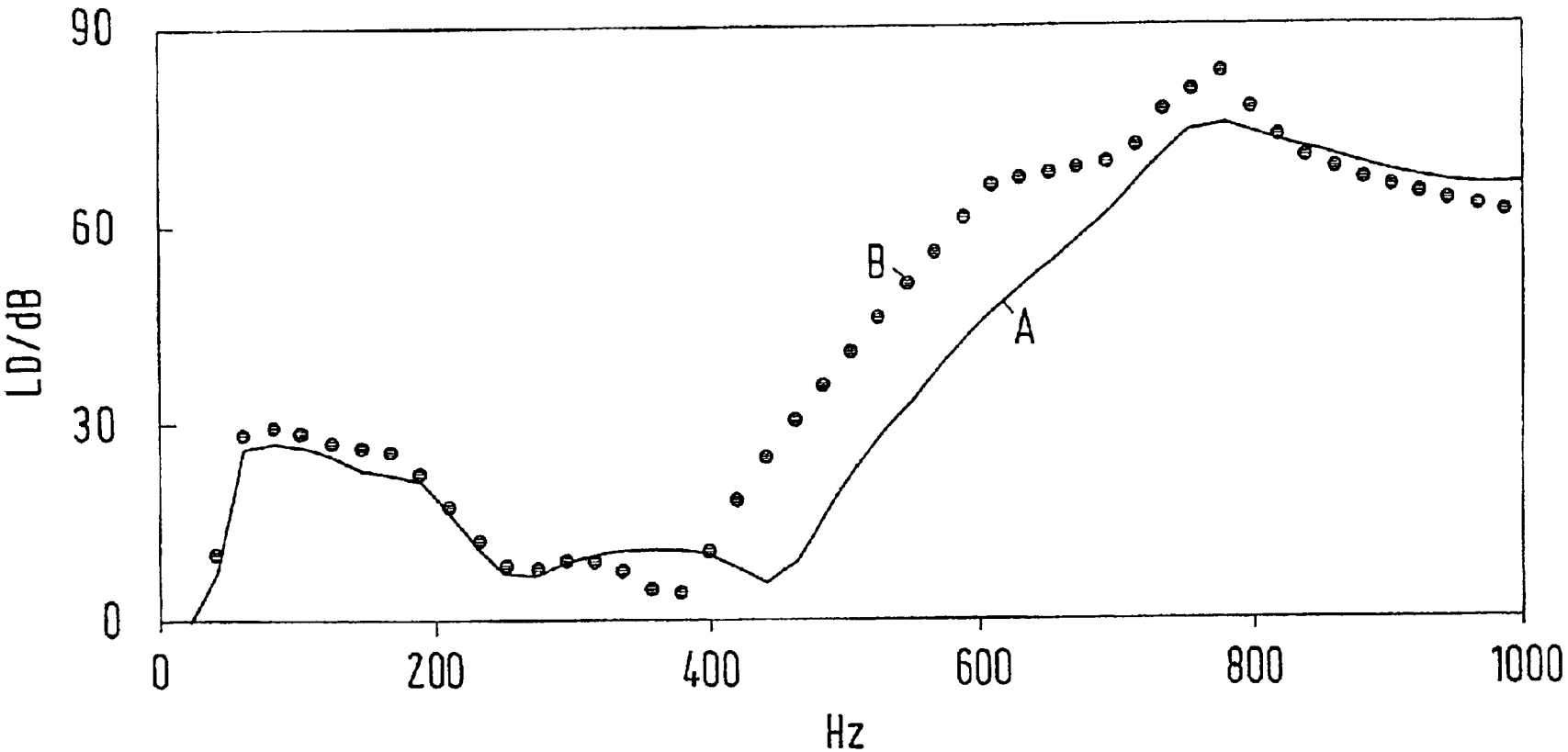
FIG. 4 is a comparison of the muffling behaviour of different suction mufflers

FIG. 4 shows a comparison of two curves representing the muffling LD in dB, for the described suction muffler 1, (curve B) in relation to a known suction muffler according to DE 199 23 734 C1 (curve A). The abscissa shows the frequency in Hz, whereas the muffling LD in dB is shown on the ordinate. In this connection, the branch channel 23 has a length and a height of approximately 18 mm, whereas the thickness, that is, the distance between the limiting wall 24 and the wall of the tubular nozzle 15 is approximately 2 mm. The diameter of the throttling channel 14 is approximately 7 mm. It is obvious that in the frequency range from approximately 400 Hz to approximately 800 Hz, in which the first hollow space resonances of the compressor housing lies, the curve B is substantially better. Thus, with the suction muffler, a substantially more silent operation of a refrigerant compressor is possible.

What is claimed is:

1. A Suction muffler for a hermetically enclosed compressor comprising:

a housing having at least a first and a second chamber, the first and second chambers being separated from each other by means of a division wall and connected with each other by means of a throttling channel, which is designed to allow flow from the first to the second chamber, and wherein the throttling channel includes a lateral opening, which opens into one of the first and second chambers via a branch channel.

2. A suction muffler according to claim 1, wherein the branch channel opens into the second chamber.

3. A suction muffler according to claim 1, wherein the throttling channel includes a tubular section in the second chamber, in which the opening is arranged.

4. A suction muffler according to claim 1, wherein the opening is in the shape of a slot and in a longitudinal direction defined by the opening the branch channel has a slot-like cross-section.

5. A suction muffler according to claim 1, wherein the opening ends at a bottom of one of the first and second chambers.

6. A suction muffler according to claim 5, wherein the branch channel is limited by the bottom of the chamber.

7. A suction muffler according to claim 5, wherein the opening is arranged at a lowest point of the chamber.

8. A suction muffler according to claim 4, wherein the length of the branch channel substantially corresponds to the height (h) of the branch channel.

9. A suction muffler according to claim 1, wherein the branch channel extends in an arch shape.

10. A suction muffler according to claim 9, wherein the branch channel runs substantially parallel to the circumferential wall of the throttling channel.

11. A suction muffler according to claim 10, wherein the circumferential wall of the throttling channel forms a limiting wall of the branch channel.

12. A suction muffler according to claim 9, wherein the branch channel is open on a face side.

* * * * *